United States Patent [19]

Schotter

[11] Patent Number: 4,925,126

[45] Date of Patent: May 15, 1990

[54] FIBER GUIDE

[75] Inventor: Daniel K. Schotter, Tucson, Ariz.

[73] Assignee: Hughes Aircraft Company, Los Angeles, Calif.

[21] Appl. No.: 284,978

[22] Filed: Dec. 15, 1988

[51] Int. Cl.[5] ..... B65H 57/12

[52] U.S. Cl. ..... 242/157 R; 156/430; 226/199; 242/47

[58] Field of Search ..... 242/157 R, 7.01, 7.02, 242/7.19, 7.21, 7.22, 2, 3, 18 G, 47, 53; 226/196, 199, 97; 156/425, 428, 429, 430, 441, 443, 446, 538, 543, 169, 175, 180

[56] References Cited

U.S. PATENT DOCUMENTS

| | | | |
|---|---|---|---|
| 2,812,850 | 11/1957 | Pape | 226/97 |
| 2,980,158 | 4/1961 | Meyer | 156/446 X |
| 3,250,493 | 5/1966 | Burkley et al. | 242/7.21 X |
| 3,492,187 | 1/1970 | Hirtzer | 156/429 |
| 3,617,414 | 11/1971 | Wesch | 156/429 X |
| 4,775,434 | 10/1988 | Rolston | 242/157 R X |

*Primary Examiner*—Stanley N. Gilreath

*Attorney, Agent, or Firm*—Michael W. Sales; Robert A. Hays; Wanda K. Denson-Low

[57] ABSTRACT

A fiber guide includes a sleeve having a longitudinal slot therealong a first member, having a notch, is fixed in the sleeve with the notch substantially aligned with the slot. A second member, also having a notch, is rotatably disposed in the sleeve. Thus, a fiber can be positioned in the notches of the first and second members and secured therein by rotating the second member. The fiber can also be readily removed from the guide, without damage or impediment, by reversing the rotation of the second member.

14 Claims, 2 Drawing Sheets

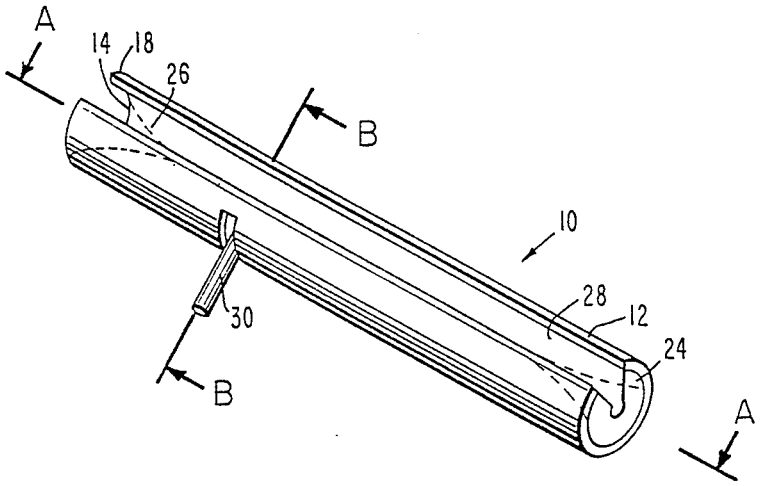
Fig. 1.
Fig. 2.
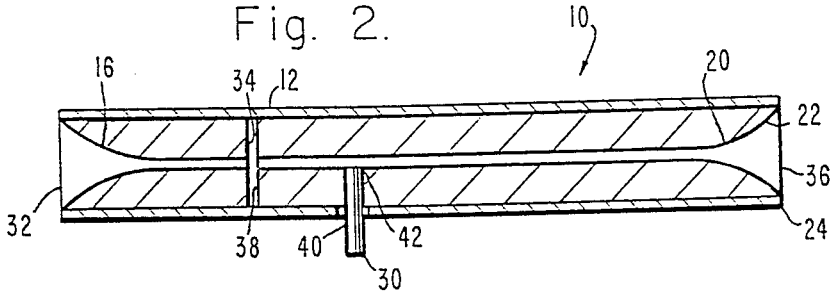
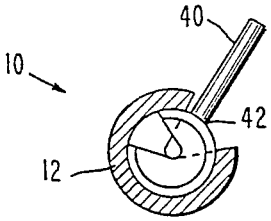
Fig. 3.

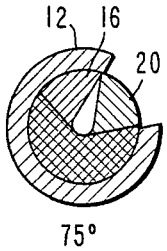
Fig. 4a.
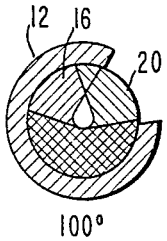
Fig. 4b.
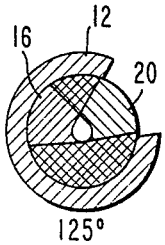
Fig. 4c.
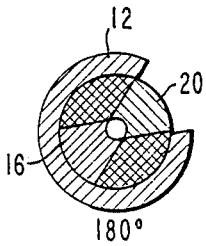
Fig. 4d.
Fig. 5.
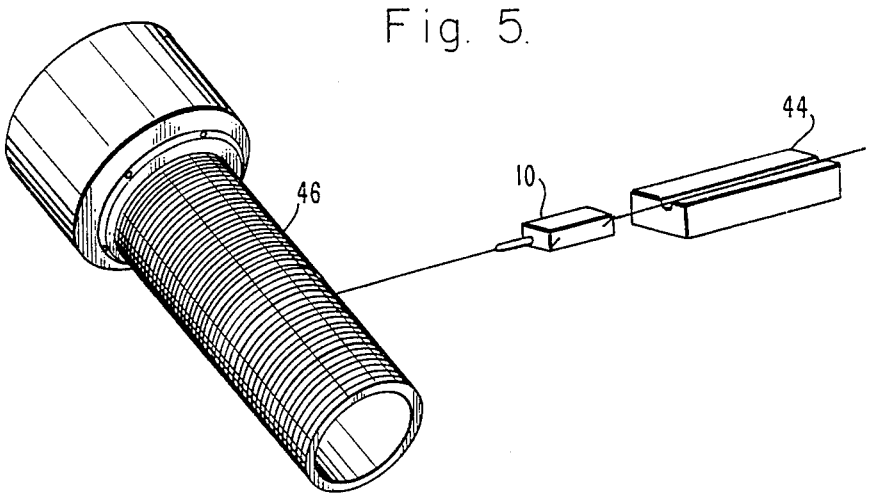

FIBER GUIDE

BACKGROUND OF THE INVENTION

The present invention generally relates to a fiber guide and, in particular, relates to such a fiber guide having an adjustable fiber aperture.

In many instances, when a fiber is wound upon a mandrel, for example, optical fibers are wound upon mandrels and used as a communication link between a control station and a projectile, some form of an adhesive is applied to the fiber to ensure that the windings upon the mandrel are retained in the proper disposition.

At the present time, the adhesive is usually applied by either one of two different techniques. One technique is to apply, generally by spraying, adhesive after each layer of fiber is wound. For example, when each layer of optical fiber is completed, the adhesive is sprayed upon that layer. Hence, in this technique, the optical fiber is wound without adhesive and the spraying of the previous layer contributes to the position retention of the subsequent layer. The spraying technique has numerous drawbacks. In particular, the mandrel, and hence the winding process, is stopped after each layer is wound so that the adhesive can be sprayed on the exposed layer. The mandrel is then incrementally rotated to apply the adhesive completely upon the layer. Thus, the winding time of a given mandrel is extended due to the need for the stopping and incrementing. Another drawback of this technique is that, regardless of various safeguards, the adhesive is difficult to apply uniformly both along and between each layer. Thus, when being unwound, the optical fiber may not unwind smoothly and become damaged due to the differing adhesive forces along the entire length thereof.

Another technique for applying an adhesive to a fiber being wound upon a mandrel is, effectively, both pressureless and continuous. These types of techniques substantially overcome the drawbacks of the spraying techniques. However, other difficulties are encountered. For example, the optical fiber, once winding has begun, cannot be removed without breakage or considerable difficulty. For example, if a flaw is found in the optical fiber being wound it may have to be returned to the manufacturer for repair. As another example, since the adhesive is applied prior to the actual winding, if the winding is interrupted the adhesive will dry and the optical fiber can become glued in the winding mechanisms. Currently, the more common apparatus utilizing this adhesive application technique include fiber guides that can be characterized as the tube/needle or the split die.

In the tube/needle fiber guide, the optical fiber is threaded through the end of a needle that traps and guides the optical fiber. Consequently, in order to remove the optical fiber, the optical fiber must either be broken or completely drawn through the needle opening. If the optical fiber is broke the fiber must thereafter be spliced and thus, the communication and/or strength characteristics thereof can be significantly reduced. If the optical fiber is drawn through the needle a substantial amount of waste can occur. Further, the needle of such an arrangement has a fixed opening and thus different apparatus are required for different sizes of optical fiber.

In the split die fiber guide the optical fiber is secured between the members of the die and drawn therethrough. However, the die assembly must be disassembled every time the optical fiber is to be removed or the winding process interrupted for an extended length of time. Further, the split die has a fixed opening and thus, different dies are required for different sizes of optical fiber.

Thus, a fiber guide is needed that not only allows removal of the fiber, without difficulty or detriment thereto, at any time and enhances uniform adhesive application but also includes an adjustable aperture to better compensate for variations in fiber size.

SUMMARY OF THE INVENTION

Consequently, it is one object of the present invention to provide a fiber guide that substantially overcomes the above-recited deficiencies of current fiber guides.

This object is accomplished, at least in part, by providing a fiber guide having, inter alia, first and second members, each having notches for receiving a fiber. The first and second members being disposed, in one preferred embodiment, in a sleeve having a longitudinal slot therein. The members being disposed within the sleeve such that, when the notches thereof are aligned with the slot, a fiber can be removed from or placed into the guide without disassembly of the guide or breaking the fiber. Further, in the preferred embodiment, one of the members is rotatable such that the aperture between the members is adjustable.

Other objects and advantages of the present invention will become apparent from the following detailed description read in conjunction with the claims appended hereto and the attached drawings.

BRIEF DESCRIPTION OF THE DRAWINGS

The drawings, not drawn to scale, includes:

FIG. 1 a perspective view of a fiber guide embodying the principles of the present invention;

FIG. 2 is a cross-sectional view, taken along the line A—A, of the fiber guide shown in FIG. 1;

FIG. 3 is a cross-sectional view, taken along the line B—B, of the fiber guide shown in FIG. 1;

FIGS. 4*a*–4*d* are cross-sectional views, taken along the line B—B, of the fiber guide shown in FIG. 1 showing different aperture settings therefor; and FIG. 5 is a perspective view of an operating environment for the fiber guide embodying the principles of the present invention.

DETAILED DESCRIPTION OF THE INVENTION

A fiber guide, generally indicated at 10 in FIGURE 1 and embodying the principles of the present invention, includes a sleeve 12 having a longitudinal opening 14 therealong, a first member 16 fixed within the sleeve 12 proximate a first end 18 of the sleeve 12. In addition, the fiber guide 10 includes a second member 20 rotatably disposed within the sleeve 12 and having one end 22 thereof proximate the second end 24 of the sleeve 12. Further, the first and second members, 16 and 20, respectively, include a first and a second notch, 26 and 28, respectively, therein. The first notch 26 of the first member !6 is substantially aligned with the longitudinal opening 14 of the sleeve 12. The fiber guide 10 also includes a means 30 for rotating the second member 20 within the sleeve 12.

In one preferred embodiment, the sleeve 12 is fabricated from a rigid material, such as, for example, stainless steel tubing and has a length greater than about an inch. Further, the sleeve 12, in this preferred embodiment has an outside diameter of about one-quarter (0.25) of an inch and a wall thickness of about three one-hundredths (0.03) of an inch. In one embodiment, the longitudinal opening 14 is formed to a width about equal to an arc that subtends about a forty degree angle.

In one preferred embodiment, the first member 16 includes first and second ends, 32 and 34, respectively, and is fixed within the sleeve 12. Preferably, the first end 32 of the first member 16 is disposed proximate the first end 18 of the sleeve 12 with the first notch 26 aligned with the longitudinal opening 14. Preferably, the first end 32 of the first member 16 is flared to about the inside diameter of the sleeve 12. In such an embodiment, the unflared diameter of the first member 16 is on the order of about 0.012 of an inch. The first notch 26 of the first member 16 is, preferably, on the order of about 20 degrees and includes a rounded bottom having a radius of about the radius of an optical fiber, for example, about 0.006 of an inch.

In the preferred embodiment, the second member 20 includes first and second ends, 36 and 38, respectively, and is disposed within the sleeve 12 with the first end 36 thereof proximate the second end 24 of the sleeve 12. In one such embodiment, the second end 38 of the second member 20 abuts and is axially aligned with the second end 34 of the first member 16. Alternatively, the first and second members, 16 and 20, can also be eccentrically aligned to provide a preselected aperture. Further, the notch 28 of the second member 20 is substantially identical to the notch 26 formed in the first member 16. Preferably, the first end 36 of the second member 20 is also flared to approximate the inside diameter of the sleeve 12 without restricting the rotation thereof.

In this embodiment, the means 30 for rotating the second member 20 within the sleeve 12 includes a handle 40 having one end 42 thereof affixed to the second member 20 and extending through a lateral slot in the sleeve 12. In order to provide the maximum possible variation of the fiber aperture through the first and second members the lateral slot extends, in this embodiment, about 180 degrees about the periphery of the sleeve 12. Preferably, the lateral slot is spaced apart from the longitudinal opening 14 in the sleeve 12. Such an arrangement maintains the structural strength of the sleeve 12.

As shown in FIG. 3, the notches of the first and second members are, in this embodiment, aligned and, since both are provided with side radii and rounded at the bottoms thereof, form an aperture through which an optical fiber is guided. Referring now to FIGS. 4*a*–4*d*, cross-sectional views of the fiber guide 10 are shown wherein handle 40 and attached second member 20 are rotated either 75 degrees, 100 degrees, 125 degrees or 180 degrees relative to first member 16. By rotating the second member 20, as shown in FIGS. 4*a*–4*d*, the size of the aperture formed at the interface of notches 26 and 28 can be varied to accommodate various sized optical fibers. By selectively rotating handle 40 and attached second member 20 by 180 degrees within sleeve 12 relative to first member 16, the smallest aperture is formed as shown in FIG. 4*d*. Preferably, in operation, the aperture is adjusted so that excess adhesive is removed from the optical fiber prior to the fiber being wound upon the mandrel. The operation of the fiber guide 10 is more fully discussed below with respect to FIG. 5.

A typical operating environment wherein the fiber guide 10 is particularly useful is shown in FIG. 5. Therein the fiber guide 10 is disposed between the reservoir 44 for retaining the adhesive and the mandrel 46 being wound. The optical fiber is drawn through the adhesive at a predetermined speed and is thereby coated with adhesive. The optical fiber is then passed through the fiber guide 10 that, in addition to guiding the fiber to the mandrel, removes excess adhesive prior to the optical fiber reaching the mandrel 46 being wound.

The fiber guide 10 thus provides a wiping action that ensures that the adhesive is substantially uniformly applied to the fiber as it reaches the mandrel. This uniformity helps prevent damage to the optical fiber when the fiber is drawn from the mandrel. Further, the optical fiber can be removed, without damage, from the fiber guide !0 to enable correction of a flaw or as to allow extended interruption of the winding procedure.

Although the present invention has been described herein with respect to a particular embodiment, those skilled in the art will recognize that other configurations and variations can be implemented without departing from the spirit and scope hereof. Hence, the present invention is deemed limited only by the claims appended hereto and the reasonable interpretation thereof.

What is claimed is:

1. A fiber guide comprising:

a sleeve, said sleeve having a longitudinal opening therealong, said opening being sized to allow a fiber to pass therethrough;

a first member fixed within said sleeve proximate a first end thereof, said first member having a first notch extending thereinto, said first notch being substantially alligned with said longitudinal opening in said sleeve such that said fiber can be disposed into said first notch through said longitudinal opening;

a second member disposed within said sleeve, said second member being rotatable within said sleeve and having a second notch extending thereinto, said second notch being alignable with said longitudinal opening such that said fiber can be disposed into said second notch through said longitudinal opening;

said first and second notches having end portions confronting one another at an interface; and means for rotating said second member to selectively vary the size of an opening formed at said interface between said first and second notches.

2. The fiber guide as claimed in claim 1 wherein said first member further comprises:

a first flared end, said first flared end of said first member being proximate said first end of said sleeve.

3. The fiber guide as claimed in claim 2 wherein said first notch comprises:

first and second radial sides and a bottom, said bottom having a radius at least equal to the radius of said fiber.

4. The fiber guide as claimed in claim 3 wherein said first member having said first notch is disposed within said sleeve such that said fiber, when disposed therein, is substantially coaxial with said sleeve.

5. The fiber guide as claimed in claim 2 wherein said second member further comprises:

a second flared end, said second flared end of said second member being proximate the second end of said sleeve.

6. The fiber guide as claimed in claim 5 wherein said second notch of said second member comprises:

first and second radial sides and a bottom, said bottom having a radius at least equal to the radius of said fiber.

7. The fiber guide as claimed in claim 6 wherein said second member is disposed within said sleeve having said bottom of said second notch thereof substantially coaxial with said sleeve such that said fiber, when disposed therein, is substantially coaxial with said sleeve.

8. The fiber guide as claimed in claim 7 wherein said first and said second members abut within said sleeve distal said first and second ends of said sleeve.

9. The fiber guide as claimed in claim 8 wherein said first notch and said second notch are substantially identical.

10. The fiber guide as claimed in claim 1 wherein said means for rotating said second member comprises:

a lateral slot extending through said sleeve about a portion of the periphery thereof; and a handle, said handle extending through said lateral slot and being affixed to said second member.

11. The fiber guide as claimed in claim 10 wherein said lateral slot extends at least 180° about said periphery of said sleeve.

12. The fiber guide as claimed in claim 11 wherein said lateral slot is disposed about a portion of said periphery of said sleeve exclusive of said longitudinal opening.

13. A fiber winding apparatus comprising:

means for applying an adhesive to a fiber;

a mandrel, said mandrel being adapted to rotate; and means, disposed between said adhesive applying means and said mandrel, for guiding said fiber therebetween, said fiber guiding means including:

a sleeve, said sleeve having a longitudinal opening therealong, said opening being sized to allow a fiber to pass therethrough;

a first member fixed within said sleeve proximate a first end thereof, said first member having a first notch extending thereinto, said first notch being substantially aligned with said longitudinal opening in said sleeve such that said fiber can be disposed into said first notch through said longitudinal opening;

a second member disposed within said sleeve, said second member being rotatable within said sleeve and having a second notch extending thereinto, said second notch being alignable with said first notch and said longitudinal opening such that said fiber can be simultaneously disposed within said first and second notches through said longitudinal opening; and means for rotating said second member to selectively vary the size of an opening formed at an interface between said first and second notches.

14. The apparatus as claimed in claim 13 wherein said adhesive applying means includes a reservoir containing said adhesive.

* * * * *